US006164959A

United States Patent [19]

Previato et al.

[11] Patent Number: 6,164,959

[45] Date of Patent: Dec. 26, 2000

[54] PILOT GAS BURNER

[75] Inventors: Armando Previato, Padua; Giuseppe Veronese, Montegrotto Terme; Antonio Sardena, Padua, all of Italy

[73] Assignee: Sit La Precisa S.p.A., Padua, Italy

[21] Appl. No.: 09/342,233

[22] Filed: Jun. 29, 1999

[30] Foreign Application Priority Data

Dec. 28, 1998 [IT] Italy ..... PD 98A000310

[51] Int. Cl.[7] ..... F23D 11/36

[52] U.S. Cl. ..... 431/154; 239/428.5; 239/434; 239/600

[58] Field of Search ..... 431/154, 343, 431/349, 354, 355; 239/428.5, 434, 600

[56] References Cited

U.S. PATENT DOCUMENTS

| | | | |
|---|---|---|---|
| 2,344,400 | 3/1944 | Ehnbom | 431/355 |
| 3,313,490 | 4/1967 | Loveland | 239/600 |
| 3,333,775 | 8/1967 | Van De Roer | 239/428.5 |
| 4,830,790 | 5/1989 | Stevenson | 239/428.5 |
| 6,027,335 | 2/2000 | Griffioen | 431/355 |

FOREIGN PATENT DOCUMENTS

| | | | |
|---|---|---|---|
| 2208776 | 9/1973 | Germany | 431/349 |

*Primary Examiner*—Ira S. Lazarus
*Assistant Examiner*—Sara Clarke
*Attorney, Agent, or Firm*—Sughrue, Mion, Zinn, Macpeak & Seas, PLLC

[57] ABSTRACT

The pilot burner described comprises a duct defining a gas-mixing chamber, a head mounted removably on the duct at a first end thereof and bearing at least one flame jet, and a gas-supply nozzle mounted in the duct for admitting gas to the chamber. The burner is of the type with a nozzle which is accessible through the first end of the duct after the head has been removed from the end, and the nozzle is fixed in a nozzle-holder which in turn is fixed removably in the duct by insertion in the duct through the first end.

16 Claims, 2 Drawing Sheets

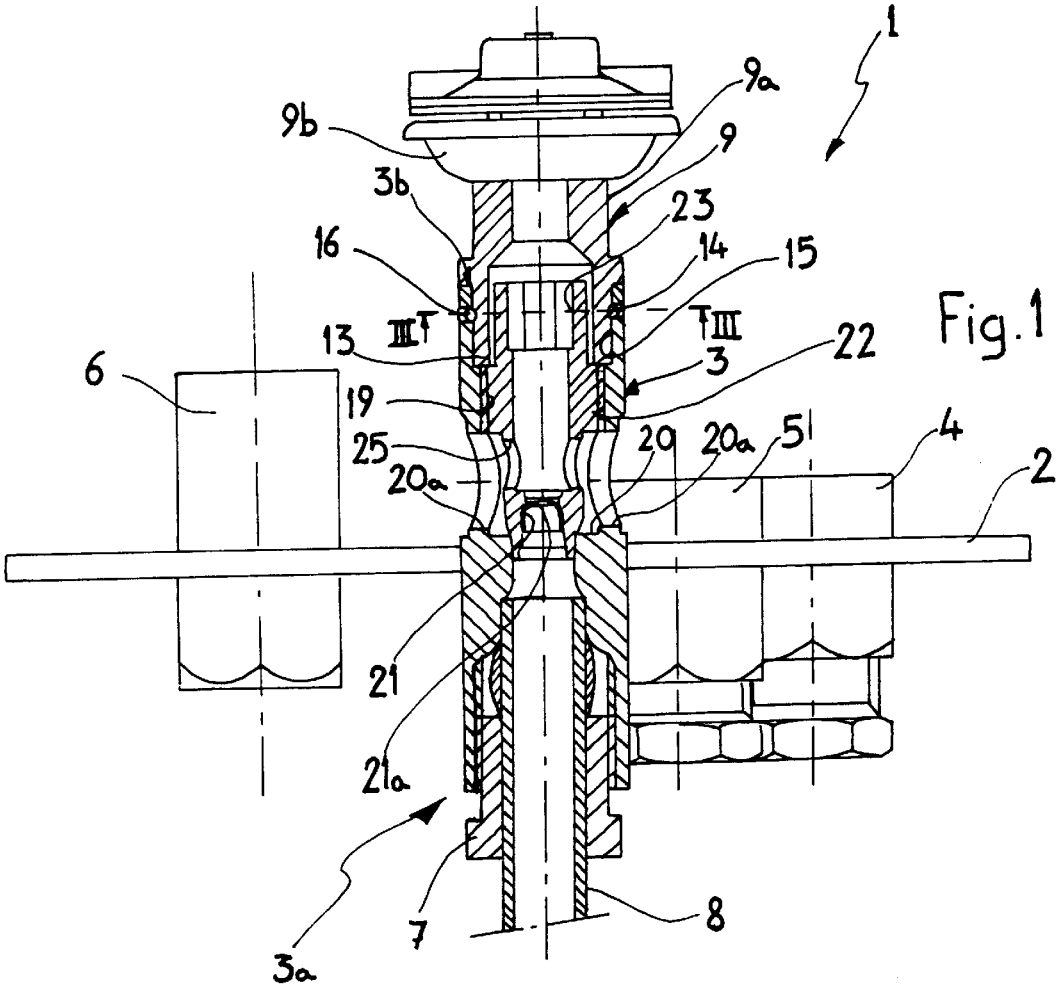
Fig.1
Fig.2
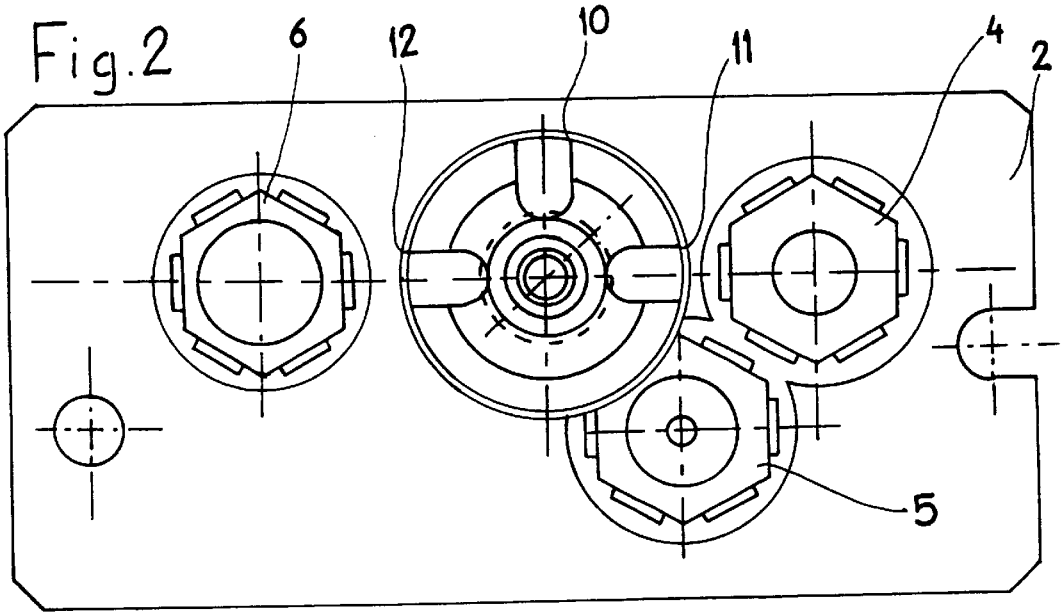

PILOT GAS BURNER

BACKGROUND OF THE INVENTION

The present invention relates to a pilot gas burner.

As is well known, devices of the above-mentioned type are used for controlling the lighting of gas burners such as those used, for example in ovens and boilers, as well as in decorative fireplaces.

Typically, a pilot burner, also known more briefly as a "pilot", has a duct which contains a nozzle and which has the task of determining the gas flow-rate, and a head mounted on the duct and carrying one or more flame jets for supplying gas to the main burner and to thermoelectric safety systems.

In pilot burners of this type, the nozzle is often mounted on the duct at the opposite end to the head, that is, it is accessible from below. This access is particularly inconvenient in pilot burners for decorative fireplaces because of they are generally in fairly inaccessible positions. There is therefore a need to have access to the gas-supply nozzle from above, that is, from the end of the duct bearing the head. To satisfy this need, in the prior art, a pilot burner has been proposed in which a counter-plate is fixed to the support plate by screws and the head of the burner is connected thereto. If the counter-plate is unscrewed, the head is released from the body of the duct, affording access to the nozzle. However, this solution is quite complex structurally and leads to some problems. In the first place, since gas-tightness between the nozzle and the duct is ensured by the tightening of the counter-plate onto the support plate, the slackening of the clamping screws of the counter-plate may cause anomalous gas leakages from the duct and between the duct and the nozzle. Moreover, since the nozzle is restrained in the duct in abutment with the head of the burner which in turn is clamped by means of the counter-plate, the removal of the head after the counter-plate has been unscrewed releases the nozzle which, owing to its small size can easily be lost.

The fixing of the counter-plate by means of screws is also quite inconvenient.

SUMMARY OF THE INVENTION

The problem upon which the present invention is based is that of providing a pilot burner which is designed structurally and functionally so as to prevent all of the problems complained of with reference to the prior art mentioned.

This problem is solved, according to the invention, by a pilot burner formed in accordance with the following claims.

BRIEF DESCRIPTION OF THE DRAWINGS

The characteristics and the advantages of the invention will become clearer from the following detailed description of a preferred embodiment thereof, described by way of non-limiting example with reference to the appended drawings, in which:

FIG. 1 is a partially-sectioned, side elevational view of a pilot burner formed in accordance with the present invention, FIG. 2 is a plan view of the burner of FIG. 1.

DETAILED DESCRIPTION OF THE INVENTION

Figure 5:
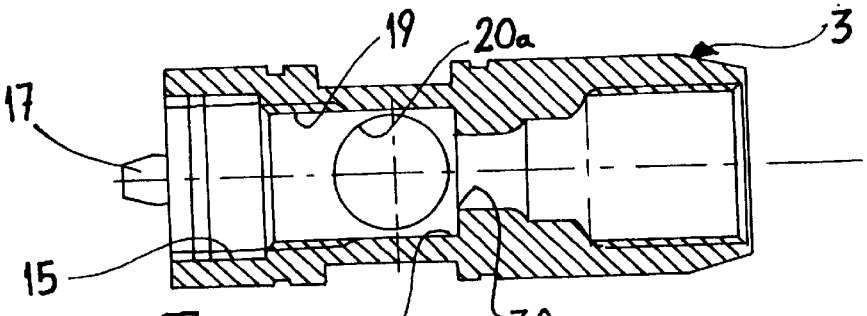
Figure 4:
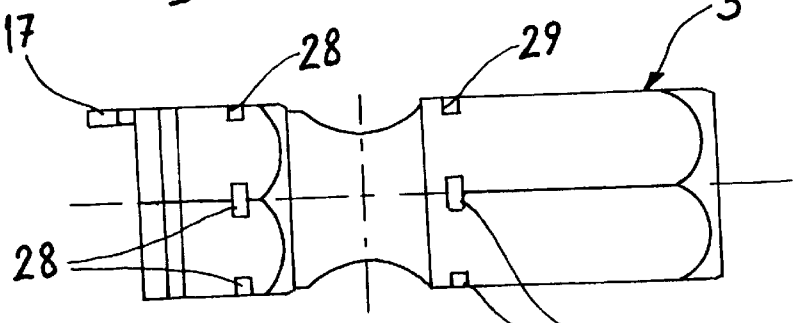
Figure 3:
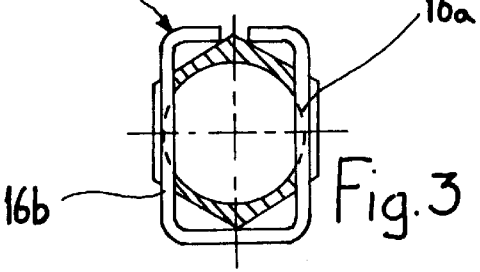
FIG. 3 is a section taken on the line III—III of FIG. 1, FIGS. 4 and 5 are a side elevational view and an axial section, respectively, showing a detail of the burner of the previous drawings on an enlarged scale.
Figure 6:
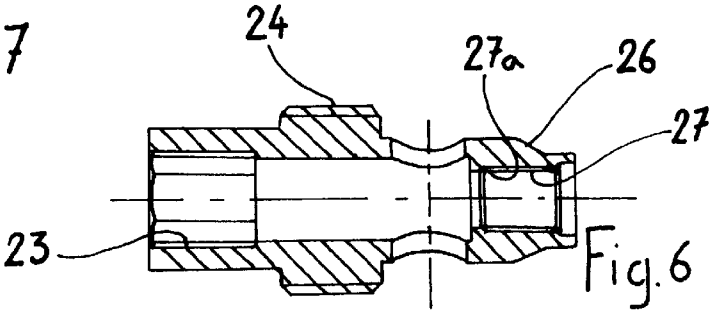
FIG. 6 is an axial section showing a further detail of the burner according to the invention on an enlarged scale.
Figure 7:
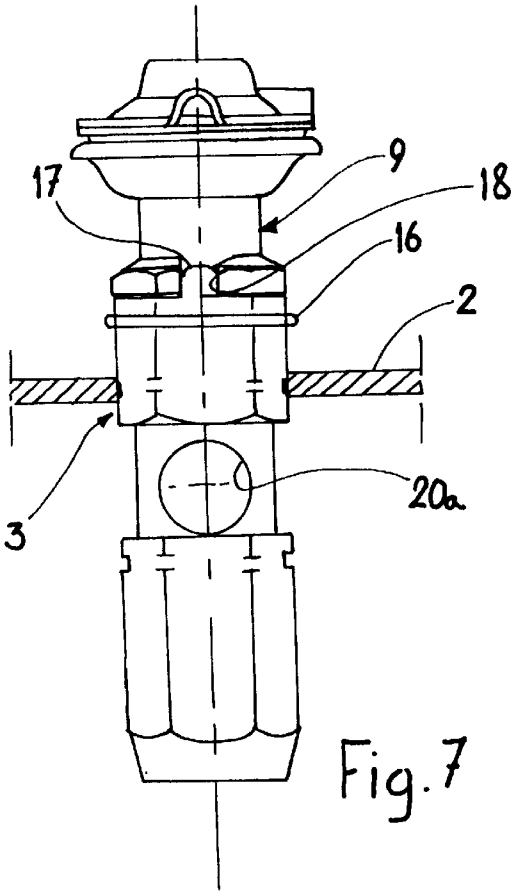
FIG. 7 is a side elevational view of the burner according to the invention.

With reference to the drawings mentioned, a pilot burner according to the present invention, for the control and lighting of a main gas burner, not shown, is generally indicated 1.

The burner 1 comprises a plate-shaped support 2 to which are fixed a duct 3 and two fixing elements, indicated 4 and 5, for the mounting of a flame detection device constituted, for example, by the hot junction of a bifilar thermocouple, and of a spark plug for lighting the pilot burner, respectively.

A third fixing element 6, for example, for the mounting of a further control device such as a flame sensor or the like, is provided on the support 2, on the opposite side of the duct 3 to the elements 4 and 5.

The duct 3 has a polygonal shape externally, is hollow internally, and extends axially between two opposite ends 3*a,* 3*b.* At the axial end 3*a,* the duct 3 is threaded internally for screw coupling with a connecting element such as, for example, an axially hollow bush 7 for the leaktight connection of the duct 3 to a duct 8 for supplying gas to the burner 1. A head 9 of the burner is mounted removably on the duct at the opposite axial end 3*b.* The head comprises a tubular duct portion 9*a,* extended by an end portion 9*b* in which the tubular duct branches into three diverging flame jets 10, 11, 12 arranged substantially at right angles to one another.

The head 9 is fixed to the duct 3 by a push-in coupling including a first coupling element and a second coupling element engageable in one another coaxially. The first element comprises a portion 13 of the outer surface of the tubular duct 9*a* in which a transverse groove 14 is formed. The second coupling element comprises an axial seat 15 of the duct 3 which can house the portion 13 of the head with a push-in coupling arrangement. The first and second coupling elements are also fixed axially relative to one another by means of a clip 16 restrained axially on the duct 3. The clip 16 comprises two opposed arms 16*a,* 16*b* which can embrace two opposite sides of the duct 3 and at least a portion of which extends into the seat 15 through through-holes formed in the duct. The arms are arranged in a manner such as to engage the groove 14 when the portion 13 is housed in the seat 15 so as to fix the head 9 axially relative to the duct 3. The arms 16*a,* 16*b* are also resiliently deformable between a first position in which they project into the seat 15 and a second position in which they are outside the seat in order to release the groove 14. It should be noted that the clip 16 is opened out resiliently by the portion 13 when this portion is fitted frontally into the seat 15 until the arms 16*a,* 16*b* engage the groove 14, bringing about axial fixing.

Alternatively, a screw means such as, for example, a grub screw, not shown, screwed into the duct and acting against the portion 13 of the head, is provided for fixing the head 9 axially relative to the duct.

The duct 3 also has a projection 17 which is intended to engage a corresponding recess 18 of the head 9 when the head is coupled with the duct so as clearly to define a relative angular orientation of the head and of the duct and consequently to ensure the correct positioning of the flame jets 10–12 relative to the lighting and flame-control devices associated therewith.

In the duct 3, the seat 15 is extended axially at the end remote from the head by an internally threaded portion 19 connected to a cylindrical gas-mixing chamber 20. Two diametrally-opposed holes 20*a* open into the chamber 20 for the supply of the primary combustion air.

The duct 3 also has a gas-supply nozzle 21 with an outlet hole 21*a*. The nozzle 21 is associated with or, alternatively, is formed integrally with, a nozzle-holder element 22 which in turn can be clamped removably inside the duct 3 in the manner explained in detail below.

The nozzle-holder 22 has a tubular body coaxial with the duct, defining a first portion with a recessed polygonal profile constituting a driving key 23, a second portion with an externally threaded cylindrical wall 24, a third portion having diametrally-opposed holes 25, and a fourth portion having an at least partially conical outer surface 26. The fourth portion defines an internal cylindrical seat 27 having an annular shoulder surface 27*a* at one end. The nozzle 21 is mounted in the seat 27 and, more particularly, the nozzle is driven into abutment with the shoulder 27*a* in the seat with slight interference. There is also provision for the nozzle to be deformed, for example, by means of localized indentations, when it is driven into the seat 27, so that accidental release of the nozzle is prevented.

The nozzle-holder 22 is housed coaxially in the duct 3 and is fixed to the latter by screwing of the second portion 24 into the threaded portion 19. When the nozzle-holder 22 is fixed in the duct by screwing, the conical surface 26 is pressed against a corresponding surface 30 of the duct, ensuring mechanical gas-tightness between the duct 3 and the nozzle-holder 22. Alternatively, gas-tightness may be achieved by the interposition of a seal. It should be noted that gas-tightness between the nozzle 21 an the nozzle-holder 22 is also mechanical and is achieved as a result of the interference fit between the cylindrical surface of the seat 27 and the corresponding coupling surface of the nozzle.

In the position shown in FIG. 1 in which the nozzle-holder is mounted in the duct 3, the holes 25 are located in the region of the holes 20 to ensure that primary air is taken in and is directed to the head 9 of the burner through the axial cavity defined in the nozzle-holder, which thus constitutes a mixing duct for the air/gas mixture supplied to the burner.

The structure of the burner according to the invention provides access to the nozzle-holder 22 and hence to the nozzle 21 from the end of the burner at which the head 9 is disposed. In fact, it suffices to remove the head 9 from the duct 3 and to unscrew the nozzle-holder 22 by means of the driving key 23. It will be noted that, when the head 9 has been removed, gas-tightness in the duct is nevertheless ensured as long as the nozzle-holder 22 is not unscrewed. It should also be noted that, when the nozzle-holder is unscrewed from the duct, the driving-key portion of the nozzle-holder projects partially from the seat 15 of the duct, facilitating gripping and subsequent extraction thereof.

Finally, the height at which the duct 3 is positioned relative to the plate-shaped support 2 is adjustable by means of a first plurality and a second plurality of indentations, indicated 28 and 29, respectively, arranged for housing, alternatively, corresponding bent appendages of the plate-shaped support in order to fix the duct relative to the support.

The invention thus solves the problem set, achieving the advantages set out above in comparison with known solutions. In the first place, the nozzle of the pilot burner is accessible easily and conveniently from the head end of the burner after the head has been removed. In the second place, the provision of a nozzle-holder according to the invention ensures gas-tightness in conditions of safety even when the head of the burner has been removed. Moreover, the provision of the snap-coupling system, together with the locating means between the head and the duct ensure the clearly-defined and correct orientation of the head of the burner relative to the lighting and flame-monitoring devices in any condition.

What is claimed is:

1. A pilot burner comprising:

a duct defining a gas-mixing chamber, a head mounted removably on the duct at a first end thereof and carrying at least one flame jet, and a gas-supply nozzle mounted in the duct for admitting gas to the chamber, the burner being in which the nozzle is accessible through the first end of the duct after the head has been removed from the said end, characterized in that the nozzle is fixed in a nozzle-holder which in turn can be fixed removably in the duct by insertion in the duct through the first end.

2. A burner according to claim 1, in which sealing means are provided between the duct and the nozzle-holder so that, when the nozzle-holder is fixed in the duct, any flow of gas in the duct, outside the nozzle, is prevented, even when the head has been removed from the duct.

3. A burner according to claim 1, in which the nozzle-holder has a driving key for the fixing of the nozzle-holder in the duct, the driving key being accessible through the first end.

4. A burner according to claim 1, in which the nozzle-holder is tubular and coaxial with the duct and has an axial length such that a portion of the nozzle-holder projects beyond the first end of the duct when the nozzle-holder is released from the duct but is still fitted therein, the said portion constituting an appendage for the gripping of the nozzle.

5. A burner according to claim 3, in which the driving key has a recessed profile.

6. A burner according to claim 2, in which the sealing means are mechanical.

7. A burner according to claim 1, in which the nozzle-holder is screwed into the duct.

8. A burner according to claim 1, in which the nozzle-holder is structurally separate from the nozzle, the nozzle being driven into a seat formed in the nozzle-holder.

9. A burner according to claim 1, in which the head has push-in coupling means and the duct has complementary coupling means so that, when the push-in coupling means and the complementary coupling means are fitted together, the head is restrained axially on the duct.

10. A burner according to claim 9, in which the push-in coupling between the head and the duct is a snap-coupling.

11. A pilot burner according to claim 9, in which the push in coupling means and the complementary coupling means comprise a first coupling element and a second coupling element disposed on the head and on the duct, respectively, and engageable in one another coaxially, axial retaining means being provided between the first coupling element and the second coupling element for fixing them together axially.

12. A pilot burner according to claim 11, in which the first element comprises an outer wall of the head having a transverse groove, the second element comprising an axial seat for housing the outer wall of the first element, and the axial retaining means comprising a third element restrained axially on the second element, at least a portion of the third element extending into the axial seat, with an arrangement such as to engage the groove when the second element is housed in the axial seat so as to fix the first and second elements together axially, and the third element being resiliently deformable between a first position in which the said portion projects into the seat and a second position in which the said portion is outside the axial seat in order to release the groove.

13. A pilot burner according to claim 12, in which the third element comprises a clip which can embrace two opposite sides of the head between its arms.

14. A burner according to claim 1, in which locating means are provided between the head and the duct for the relative positioning thereof, in order clearly to define a predetermined angular orientation between the head and the duct.

15. A burner according to claim 14, in which the locating means comprise a projection on one of the head and the duct and a recess on the other, the projection and the recess being mutually engageable.

16. A pilot burner according to claim 1, in which the duct is mounted on a support and means are provided on the duct for positioning the duct at a variable height relative to the support.

* * * * *